US005278620A

United States Patent [19]

Godlove

[11] Patent Number: 5,278,620

[45] Date of Patent: Jan. 11, 1994

[54] CLEANING BLADE EQUIPPED WITH A VIBRATION SENSOR

[75] Inventor: Ronald E. Godlove, Bergen, N.Y.

[73] Assignee: Xerox Corporation, Stamford, Conn.

[21] Appl. No.: 910,065

[22] Filed: Jul. 8, 1992

[51] Int. Cl.[5] ..... G03G 21/00

[52] U.S. Cl. ..... 355/299; 355/203; 15/256.5

[58] Field of Search ..... 355/296, 297, 299, 203; 15/256.51, 256.5; 324/71.1

[56] References Cited

U.S. PATENT DOCUMENTS 4,465,362 8/1984 Tohma et al. ..... 15/256.51 X
4,501,486 2/1985 Landa ..... 15/256.5 X
4,819,026 4/1989 Lange et al. ..... 15/256.51 X

*Primary Examiner*—R. L. Moses
*Assistant Examiner*—Thu Dang
*Attorney, Agent, or Firm*—Oliff & Berridge

[57] ABSTRACT

A piezoelectric sensor is mounted on the cleaning blade and/or the blade support member of a blade cleaning apparatus contained within a electrostatic copying machine. The piezoelectric sensor generates a waveform indicative of the wear characteristics of the cleaning blade and pressure loading of the cleaning blade against the photosensitive surface. A detection circuit monitors the waveform generated by the piezoelectric sensor to predict the imminent failure of the cleaning blade due to wear and damage. The detection circuit also monitors the waveform to detect a build up of frictional and adhesional forces between the cleaning blade and the photosensitive surface and adjusts the pressure loading through a feedback loop to extend the usable life-span of the cleaning blade. Thus, unscheduled maintenance due to sudden and unpredictable failure of the cleaning blade can be avoided and the usable life-span of the cleaning blade can be extended.

32 Claims, 4 Drawing Sheets

CLEANING BLADE EQUIPPED WITH A VIBRATION SENSOR

BACKGROUND OF THE INVENTION

1. Field of the Invention

The present invention relates to a cleaning apparatus for removing substances from a surface and in particular to a blade cleaning device for use in an image forming device such as an electrostatic copying machine to remove residual toner particles and unwanted substances from a photosensitive surface.

2. Discussion of the Related Art

In an electrophotographic process, such as xerography, an optical device oscillates a light pattern along a charged photosensitive surface to form a latent image corresponding to an electrical or optical input. The resulting pattern of charged and discharged areas on the surface forms an electrostatic latent image corresponding to the original image. Developing devices of the electrostatic copying machine develop the latent image using yellow, magenta, cyan, and/or black developing toners. The developing toners are composed of electrostatically attractable powder and are attracted to the latent image areas formed on the charged photosensitive surface. The developed image is then transferred to a predetermined image medium, e.g., paper, to produce a reproduction and a permanent record of the original image.

When the developed image is transferred onto a paper, a majority of developing toner is transferred to the paper. However, some residual toner remains on the charged photosensitive surface because of the relatively high electrostatic and/or mechanical forces between the electrostatically attracted toner and the charged photosensitive surface. Further, other unwanted substances, e.g., paper fibers, Kaolin, debris, etc., are attracted to the charged photosensitive surface and remain on the charged photosensitive surface. Because the residual toner and unwanted substances left on the charged photosensitive surface will degrade the quality of the reproduced image, it is essential to remove the residual toner and unwanted substances from the charged photosensitive surface during each image development process.

Blade cleaning is a highly desirable method for removing the residual toner and unwanted substances because it is simple and inexpensive compared to the various known fiber or magnetic brush cleaners A blade cleaning device comprises a relatively thin elastomeric cleaning blade member which is provided and supported adjacent to the charged photosensitive surface and is transverse to the charged photosensitive surface relative to the direction of the relative movement. The cleaning blade has a blade edge chiselling or wiping the residual toner from the charged photosensitive surface during the doctoring mode or wiping mode, respectively. Thus, the residual toner and unwanted substances are removed from the surface prior to developing another latent image on the charged photosensitive surface. The removed residual toner and unwanted substances which accumulate adjacent to the cleaning blade are transported away from the cleaning blade area by a toner transport arrangement or by gravitational force.

However, the blade cleaning method has certain deficiencies caused by the frictional and adhesional forces between the cleaning blade and the charged photosensitive surface. The frictional and adhesional forces cause a wearing away of the cleaning blade edge and damages the charged photosensitive surface.

Further, the cleaning blade is subject to unpredictable failures due to improper and excessive tuck characteristics. Normally, the blade cleaning edge or tip is tucked slightly when the cleaning blade edge or tip is chiselling or wiping the toner from the charged photosensitive surface and slides on the toner particles and lubricants to maintain a sealing contact required for cleaning. During removal of the residual toner and unwanted substances, the cleaning blade may flatten toner that passes underneath the blade edge and cause compaction of toner on the charged photosensitive surface. The impact from carried beads of toner remaining on the charged photosensitive surface subsequent to development may damage the cleaning blade due to sudden localized increase in frictional and adhesional forces between the cleaning blade and the charged photosensitive surface. Such sudden increase in frictional and adhesional forces cause the phenomenon of excessive tucking, i.e., blade foldover, where the blade cleaning edge becomes tucked underneath the blade. As a result, the cleaning blade looses the frictional and adhesional sealing relationship required for blade cleaning. Such problems ultimately require removal and replacement of the cleaning blade because the blade is torn or is so distorted in shape that the cleaning blade no longer functions to remove the residual toner and unwanted substances.

U.S. Pat. No. 4,937,633 to Ewing, assigned to Xerox Corporation, discloses a cleaning blade defect sensing arrangement. An elastomeric cleaning blade supported in cleaning relationship with an imaging surface of an electrophotographic device is provided for removal of residual toner on the surface and has a cleaning edge having predetermined and detectable characteristics. An electrical signal is applied to the cleaning edge and variations in the electrical characteristics are monitored. Changes in the electrical characteristics of the cleaning blade edge will be highly indicative of a cleaning blade failure, or impending failure. A signal based on the variation in electrical characteristics may be produced to create a warning indication or cause a corrective response to occur.

U.S. Pat. No. 4,942,387 to Thomas discloses a device for determining cutting tool wear and breakage. The device has a vibration sensor, such as an accelerometer, which is mounted on or near the tool. An output signal from the sensor is computed into functions of AC and DC power of the vibration signals. The functions are then compared and if the relationship between the AC and DC power changes beyond selected limits, an alarm is sounded or flashed.

U.S. Pat. No. 4,894,644 to Thomas discloses a method and device for detecting gradual wear or breakage of a machine tool which occurs over a period of time by sensing high frequency vibrations produced at a cutting tool/workpiece interface during a machining process. High frequency vibrations are converted to a unipolar vibration signal which is processed to produce a tracking signal and tracks the minimum value of the vibration signal. The vibration signal is related to the effective cutting energy and it decreases due to gradual tool wear or breakage. The tracking minimum signal is compared to a predetermined threshold level to detect excessive wear or breakage of the tool and is provided with an alarm.

U.S. Pat. No. 4,744,242 to Anderson et al. discloses a method for monitoring cutting tool wear during a machining operation. The vibration of an end mill is sensed by either microphones or accelerometers. A time domain signal is produced by these sensors which is converted into a near-real time frequency spectrum. A certain frequency band in the spectrum is directly related to the end mill vibration and certain frequencies in the band will change in amplitude corresponding to certain types of end mill wear. When any of the amplitudes in the band exceed a certain threshold limit, the machine control unit may cause operations to stop, or a monitor may continuously communicate tool wear data to a front end processor which may then issue commands to a machine control unit in response to the tool wear data.

None of the above U.S. patents discloses a cleaning blade having a piezoelectric sensor for generating an electrical signal which indicates the condition of the cleaning blade. Further, none of the above U.S. patents discloses a feedback loop to control the pressure loading of the cleaning blade for the purpose of extending the usable life-span of the blade.

SUMMARY OF THE INVENTION

It is an object of the present invention to provide an image forming device having an improved cleaning blade.

It is another object of the present invention to avoid unscheduled maintenance of the image forming device due to sudden failure of the cleaning blade.

It is another object of the present invention to monitor a build up of frictional and adhesional forces between the cleaning blade and the charged photosensitive surface.

It is another object of the present invention to predict the failure of the cleaning blade based on an electrical signal waveform generated by a piezoelectric sensor over a period of time.

It is a further object of the present invention to provide a blade cleaning device having a piezoelectric sensor which generates an electrical signal indicative of the wear characteristics of the cleaning blade.

It is a further object of the present invention to provide a feedback loop to adjust the pressure loading of the cleaning blade against the charged photosensitive surface based on an electrical signal generated by a piezoelectric sensor in order to reduce the wear and failure of the cleaning blade.

It is another object of the present invention to extend the usable life-span of a cleaning blade.

It is also an object of the present invention to provide a low cost cleaning technology for image forming devices.

To achieve the foregoing and other objects and advantages, and to overcome the shortcomings discussed above, a cleaning blade has a piezoelectric sensor which generates a waveform having: 1) varying average voltage amplitude to indicate the wear characteristics of the cleaning blade; and 2) sharp increases in voltage amplitude to indicate a build up of frictional and adhesional forces between the tip of the cleaning blade and the charged photosensitive surface of the photoreceptor belt of a electrostatic copying machine. To detect such waveform and to extend the usable life-span of the cleaning blade, a detection circuit is connected to the piezoelectric sensor. The detecting circuit incorporates a feedback loop between the piezoelectric sensor and the pressure loading device to adjust or interrupt the pressure loading of the cleaning blade against the charged photosensitive surface when the detection circuit detects sharp increases in the voltage amplitude of the piezoelectric generated waveform. Further, the detecting circuit detects the changing average voltage amplitude to determine the wear characteristics of the cleaning blade. Thus, the detecting circuit can predict the imminent failure of the cleaning blade and extend the usable life-span of the cleaning blade.

The present invention is applicable to any type of cleaning blade to avoid unscheduled maintenance of a device due to sudden failure of the cleaning blade. Further, the present invention is applicable to any type of cleaning blade to extend the usable life-span of the cleaning blade.

BRIEF DESCRIPTION OF THE DRAWINGS

The invention will be described in detail with reference to the following drawings in which like reference numerals refer to like elements wherein.

DETAILED DESCRIPTION OF THE PREFERRED EMBODIMENT

Figure 1:
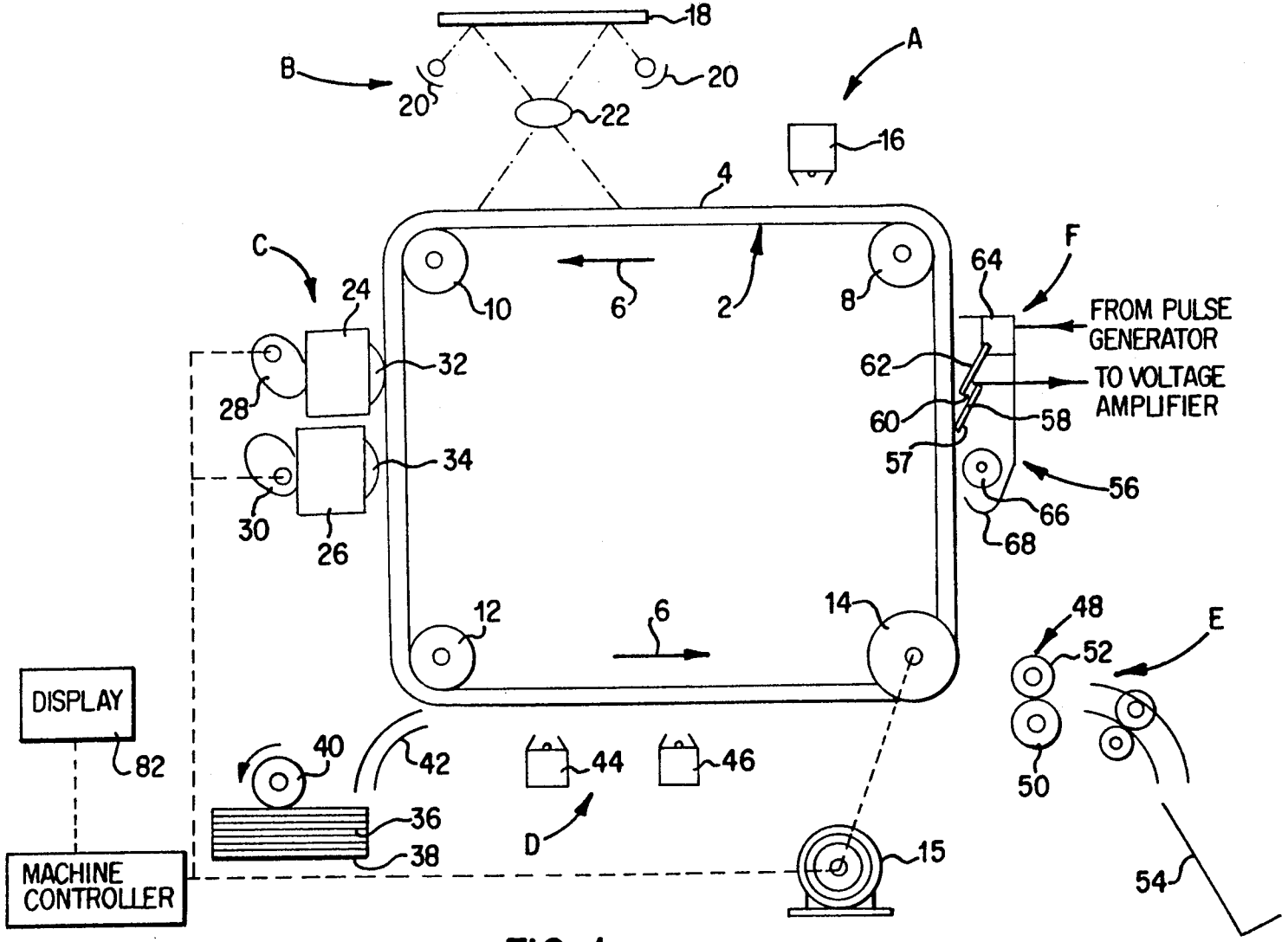
FIG. 1 illustrates an image forming device incorporating the present invention.

FIG. 1 is a schematic drawing of an electrostatic copying machine incorporating the cleaning blade of the present invention. During a copying process, a photoreceptor belt 2 having a photosensitive surface 4 moves in the direction of arrow 6 to advance portions of the belt successively through charging station A, exposure station B, development station C, transfer station D, fusion station E, and cleaning station F.

Photoreceptor belt 2 is entrained about a stripping roller 8, tension rollers 10 and 12, and a dry roller 14. Dry roller 14 is coupled to a motor 15 by suitable means such as a belt drive (not shown). The photoreceptor belt 2 is maintained and tensioned by a pair of springs (not shown) resiliently urging tension rollers 10 and 12 against photoreceptor belt 2 with the desired spring force. Stripping and tension rollers 8, 10 and 12 are idlers and rotate freely as photoreceptor belt 2 moves in the direction of arrow 6.

At charging station A, a corona device 16 charges photoreceptor belt 2 to a relatively high and substantially uniform positive or negative potential.

At exposure station B, an original document is positioned face down on a transparent platen 18 for illumination with flash lamps 20. Light rays reflected from the original document are reflected through a lens 22 and projected onto a charged portion of photoreceptor belt 2 to selectively dissipate the charge thereon. The resulting pattern of charged and discharged areas forms an electrostatic latent image corresponding to the informational area contained within the original document. Alternatively, a laser system may be provided to discharge photoreceptor belt 2 in accordance with stored electronic information.

Thereafter, photoreceptor belt 2 advances the electrostatic latent image to development station C. At development station C, one of at least two developer housings 24 and 26 is brought into contact with photoreceptor belt 2 for the purpose of developing the electrostatic latent image. Developer housings 24 and 26 may be moved into and out of developing position with corresponding cams 28 and 30, which are selectively driven by motor 15. Each developer housing 24 or 26 supports a developing system, such as magnetic brush rolls 32 and 34, which provides a rotating magnetic member to advance developer mix (i.e., carrier beads and toner) into contact with the electrostatic latent image. The electrostatic latent image attracts toner particles from the carrier beads, thereby forming toner powder images, i.e., developed images, on photoreceptor belt 2. It can be appreciated that if two colors of developer material are not required, the second developer housing may be omitted. Further, if more than two colors are needed, additional developer housings may be added.

Photoreceptor belt 2 then advances the developed latent image to transfer station D; however, prior to transfer station D, a sheet of predetermined image medium, e.g., paper, is advanced into contact with the developed latent images on photoreceptor belt 2. Sheets of paper 36 are advanced to transfer station D from a supply tray 38. Sheets are fed from tray 38 with a sheet feeder 40 and are advanced to transfer station D along a conveyor 42.

At transfer station D, a corona generating device 44 charges the paper to the proper potential so that the paper is tacked to photoreceptor belt 2 and the toner powder image is attracted from photoreceptor belt 2 to the sheet of paper. After transfer, a corona generator 46 charges the copy sheet to an opposite polarity to detach the copy sheet from photoreceptor belt 2, whereupon the sheet is stripped from belt 2 at roller 14 and moves to fusing station E.

Fusing station E includes a fuser assembly 48 which permanently affixes the transferred developed image to the copy sheet. Preferably, fuser assembly 48 includes a heated fuser roller 50 adapted to be pressure engaged with a back-up roller 52 with the developed image contacting fuser roller 50. In this manner, the developed image is permanently affixed to the sheet, and such sheets are directed to an output 54 or finisher.

At cleaning station F, a blade cleaning apparatus 56 of the present invention removes the residual toner and unwanted substances left on photoreceptor belt 2 after the developed image has been transferred to the paper. Blade cleaning apparatus 56 comprises a cleaning blade 58, a sensor 60, a blade support member 62, a pressure loading device 64, and an auger 66 which are all contained within a housing 68.

In the preferred embodiment, sensor 60 is bonded in between cleaning blade 58 and blade support member 62. One end of blade support member 62 is coupled to pressure loading device 64 and a tip 57 of cleaning blade 58 is pressure loaded against photoreceptor belt 2 by pressure loading device 64. Blade support member 62 is made of a rigid metal. Cleaning blade 58 is made of a polyurethane elastomer and sensor 60 is a Kynar TM piezoelectric sensor. However, it can be appreciated that other suitable materials for the cleaning blade may be used and other types of piezoelectric sensors can be used. The piezoelectric sensor in the preferred embodiment should be inexpensive, light in weight, and relatively thin in dimensional thickness and should have good sensitivity.

Figure 2:
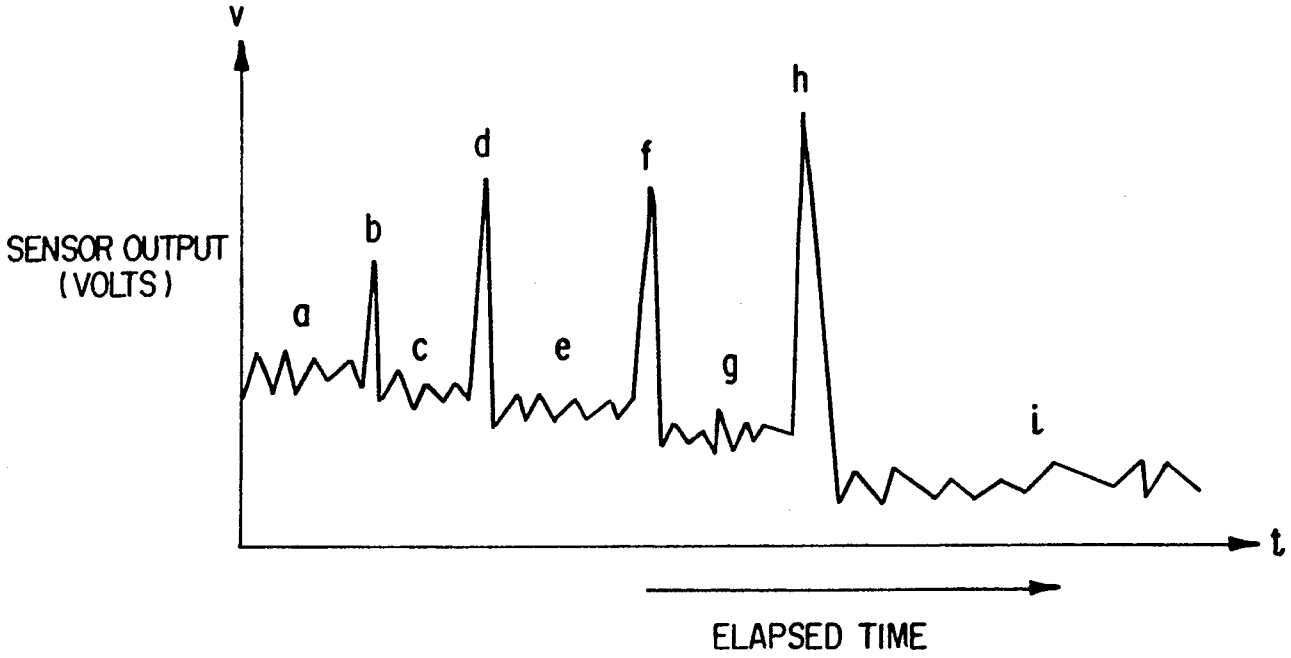
FIG. 2 illustrates the detected waveform generated by the piezoelectric sensor for a new blade, a worn blade, and a blade which has undergone complete failure of the blade cleaning edge with intermittent peaks indicating build up of frictional and adhesional forces between the cleaning blade and the charged photosensitive surface.

As shown in FIG. 2, piezoelectric sensor 60 generates an electrical signal waveform which indicates the condition of the cleaning blade over a period of time/period of blade use. The voltage of the electrical signal varies to indicate various wear characteristics of cleaning blade 58. Waveform a typifies an undamaged or new cleaning blade working against the photoconductive surface of the photoreceptive belt. The jagged ripples in waveform a is indicative of the normal but limited amount of stick/slip cycling that occurs in a normal operation.

During normal operation, the frictional and adhesional forces cause portions of the cleaning blade edge to adhere, i.e., "stick", to charged photosensitive surface 4. The movement of photosensitive belt 2 breaks the adhesion due to the frictional and adhesional forces and suddenly releases the cleaning blade edge from charged photosensitive surface 4. The sudden release of the cleaning blade edge causes the cleaning blade edge to "slip" against the charged photosensitive surface prior to regaining the frictional and adhesional sealing relationship with the charged photosensitive surface. The leading edges, i.e., $\Delta V/\Delta t$=positive value, of the jagged ripples in waveform a are indicative of the "stick", and the trailing edges, i.e., $\Delta V/\Delta t$=negative value, of the jagged ripples are indicative of the "slip". The toner and lubricants therein limit the amount of the "stick" and "slip" in the stick/slip cycle.

When some portion of the cleaning blade edge has no toner along the contact of the cleaning blade edge and the charged photosensitive surface, sensor 60 generates a sudden increase in voltage, which is indicated as waveform b, due to an excessive and sudden build up of frictional and adhesional forces between the charged photosensitive surface 4 and cleaning blade 58. An abnormally large adhesion due to the excessive and sudden build up of frictional and adhesional forces between cleaning blade 58 and charged photosensitive surface 4 results in tearing and damage to cleaning blade 58 when the adhesion is broken by the continual forward movement of photoreceptor belt 2.

Waveform c identifies a lessening of the frictional and adhesional forces between cleaning blade 58 and charged photosensitive surface 4 after cleaning blade 58 has undergone some permanent deformation and damage. The cleaning blade 58, however, can substain a certain amount of deformation and damage and continue to adequately clean the charged photosensitive surface. Waveforms d, f, and h identify subsequent events of the same nature as described above for waveform b. Waveforms e, g, and i identify the same conditions as described above for waveform c.

After each destructive and uncontrolled stick/slip cycle (as indicated by waveforms b, d, f, and h), there is a lessening of frictional and adhesional sealing relationship between cleaning blade 58 and photosensitive surface 4 and is indicated by a decrease in average voltage amplitude of the electrical signal generated by sensor 60 as shown in waveforms c, e, g and i. Thus, the voltage output generated by sensor 60 over a period of blade use indicates the condition of the cleaning blade. For example, as cleaning blade 58 becomes more worn and damaged, the average voltage amplitude of waveforms c, e, g and i decreases relative to waveform a. By monitoring the sensor output, the condition of the blade can be determined, and the imminent failure of cleaning blade 58 due to damage can be predicted.

Moreover, by monitoring the sensor output to detect the higher slopes of the leading edges of waveforms b, d, f and h, the build up of frictional and adhesional forces between tip 57 of cleaning blade 58 and charged photosensitive surface 4 can be detected. Based on the detected sensor output, the pressure loading of blade tip 57 against charged photosensitive surface 4 may be adjusted to interrupt or lessen the build up of frictional and adhesional forces which would otherwise result in the damage of the cleaning blade.

Figure 3:
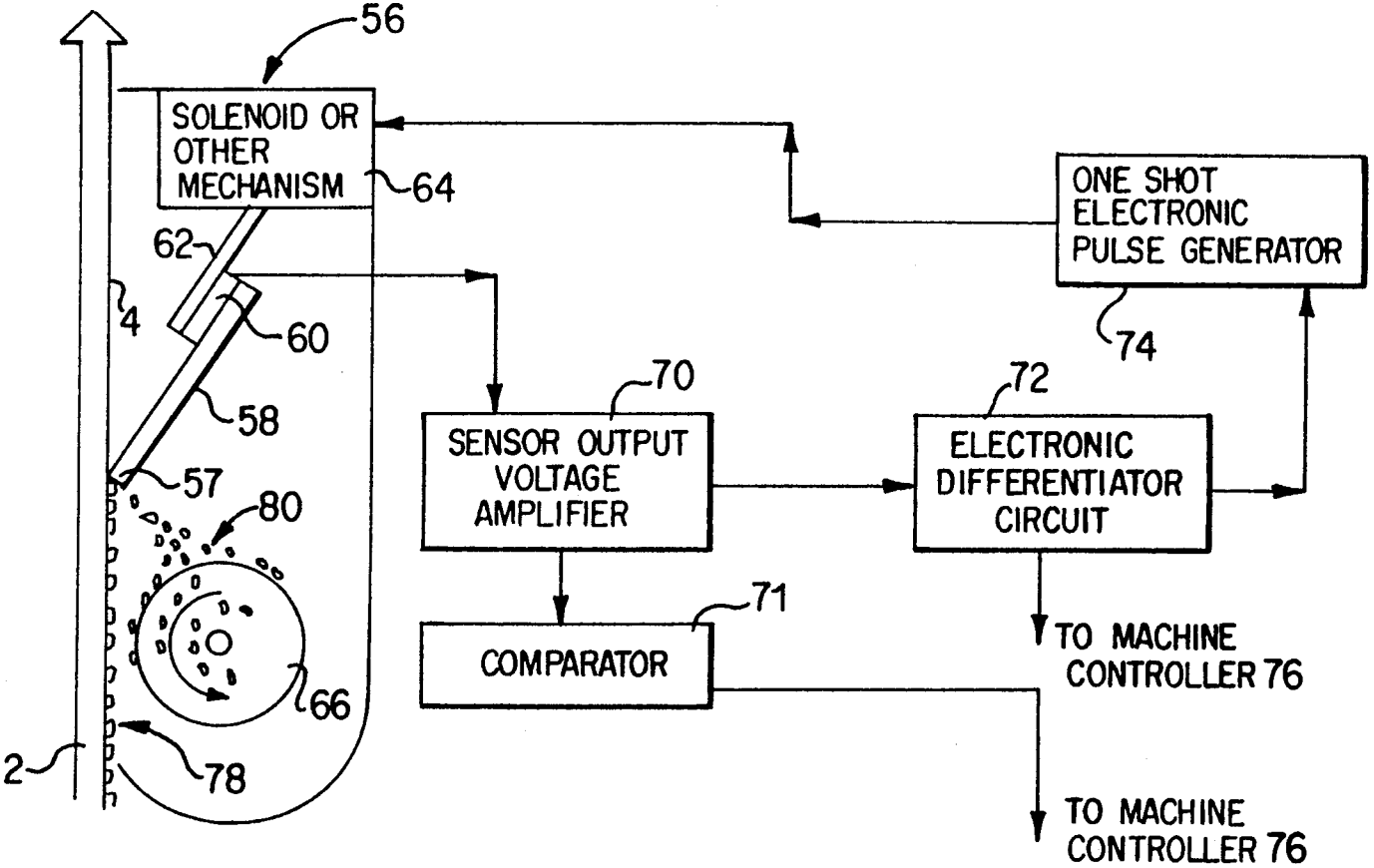
FIG. 3 illustrates the operation of the blade cleaning apparatus with a detection circuit for detecting the amplitude variation of the electrical signal waveform generated by the piezoelectric sensor and the feedback loop to control the pressure loading of the blade.

FIG. 3 illustrates the operation of the blade cleaning apparatus with a detection circuit for detecting amplitude voltage variations of the electrical signal generated by sensor 60 and a feedback loop to adjust the pressure loading of cleaning blade 58 against charged photosensitive surface 4. In operation, as charged photosensitive surface 4 of photoreceptor belt 2 traverses tip 57 of cleaning blade 58, cleaning blade 58 chisels or wipes off residual toner and other unwanted substances 78 from the charged photosensitive surface 4. As illustrated, cleaning apparatus 56 is vertically placed within the electrostatic copy machine, and as a result, the force of gravity facilitates the movement of removed residual toner and unwanted substances 80 toward auger 66. Removed residual toner and unwanted substances collected by auger 66 are either stored for dispersement or reprocessed through a replenishing system (not shown) for reuse at development station C.

The detection circuit comprises a sensor output voltage amplifier 70, a comparator 71, an electronic differentiator circuit 72, and an one shot electronic pulse generator 74. The detection circuit creates a feedback system between sensor 60 and pressure loading device 64. Sensor output voltage amplifier 70 amplifies the piezoelectric electrical signal and sends the amplified signal to comparator 71 and electronic differentiator circuit 72.

As discussed above, the decrease in average voltage amplitude of the sensor output indicates the wear and damage of cleaning blade 58. Thus, by periodically monitoring the average voltage amplitude voltage of the sensor output, comparator 71 can predict the imminent failure of cleaning blade 58. For example, if waveform i represents a total failure of the cleaning blade, comparator 71 will output a signal to machine controller 76 when it detects an average voltage amplitude of waveform g to indicate imminent failure of cleaning blade 58.

Machine controller 76 will notify an operator of the electrostatic machine of the imminent failure by activating a display 82 on the image forming device. Thus, a service technician can replace a worn cleaning blade prior to total failure of cleaning blade 58 and unscheduled maintenance of the image forming device due to sudden failure of the cleaning blade can be avoided. Further, it can be appreciated that the function of comparator 71 can be incorporated into machine controller 76 through software programming of machine controller 76 to detect the imminent failure.

Differentiator circuit 72 monitors the amplified signal to detect the higher slopes of the leading edges of waveforms b, d, f, and h. Differentiator circuit 72 may, for example, consist of capacitors and resistors in a filtering arrangement and uses the RC time constant to continuously detect the leading edges of the waveforms. When such peak has been detected, differentiator circuit 72 sends an output signal to activate one shot electronic pulse generator 72.

Depending on the output signal, one shot electronic pulse generator 74 sends a pulse signal to pressure loading device 64, for example, a solenoid or other suitable mechanism, connected to blade support member 62 to momentarily interrupt or lessen the pressure loading of cleaning blade tip 57 against charged photosensitive surface 4. Thus, the feedback loop prevents the build up of frictional and adhesional forces that would otherwise result in the damage to cleaning blade 58, and thereby extends the usable life-span of cleaning blade 58. Further, differentiator circuit 72 sends a signal to machine controller 76 to indicate that the cleaning blade has been damaged, and machine controller 76 will notify an operator of the damage by activating display 82.

Figure 4A:
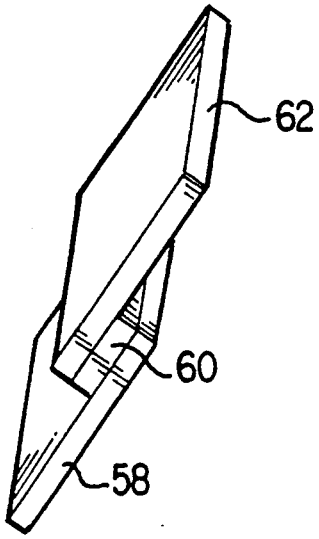
FIGS. 4A–4C illustrate various positioning of the piezoelectric sensor on the cleaning blade and/or blade support member.
Figure 4B:
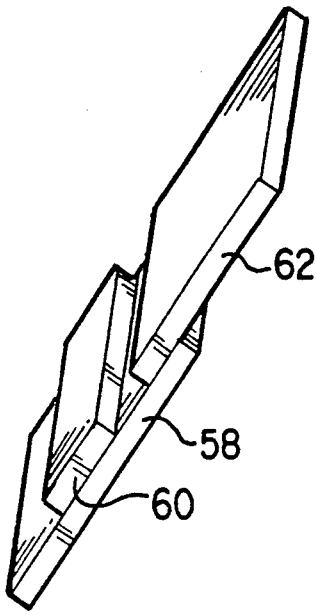
Figure 4C:
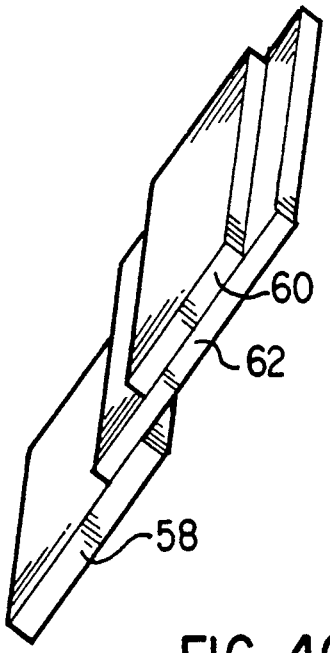

FIG. 4A illustrates the positioning of piezoelectric sensor 60 between cleaning blade 58 and blade support member 62 of the preferred embodiment. However, as shown in FIGS. 4B and 4C, piezoelectric sensor 60 can be placed on cleaning blade 58 or blade support member 62 to monitor the condition of cleaning blade 58. Moreover, it can be appreciated that sensor 60 can be positioned at other suitable locations to generate an electrical signal indicative of the blade condition.

While this invention has been described in conjunction with specific embodiments thereof, it is evident that many alternatives, modifications and variations will be apparent to those skilled in the art. The above cleaning blade can also be used for removal of toner from a surface of a detoning roll used to collect toner from the bristle of a brush cleaner. Further, the above cleaning blades can be also used for the cleaning blade of an image forming device having photosensitive drums. Thus, the foregoing embodiments are intended to be illustrative and not limiting. Various modifications may be made without departing from the spirit and scope of the invention as defined in the following claims.

What is claimed is:

1. An image forming apparatus comprising:

means for creating a latent image on a photosensitive surface;

means for converting said latent image into a developed image by applying toner on said latent image;

means for transferring said developed image onto a predetermined image medium; and means for cleaning residual toner remaining on said photosensitive surface, said cleaning means having a blade member contacting said photosensitive surface, means for pressure loading said blade member against said photosensitive surface, and a sensor on said blade member, said sensor generating an electrical signal to indicate conditions of said blade member; and a feedback loop to adjust the pressure loading of said blade member against said photosensitive member based on said electrical signal, thereby extending the usable life-span of said blade member.

2. The image forming device of claim 1, wherein one of the conditions indicated by said electrical signal is a build up of frictional or adhesional forces between said blade member and said photosensitive surface.

3. The image forming device of claim 1, wherein said electrical signal varies as said blade member becomes more worn over a period of blade use, and certain variations of said electrical signal indicate imminent failure of said blade member.

4. The image forming device of claim 1 further comprising:

an amplifier coupled to said sensor, said amplifier outputting an amplified signal of said electrical signal; and a circuit coupled to said amplifier, said circuit monitoring said amplified signal to predict imminent failure of said blade member and generating a signal indicative of imminent failure such that an operator will replace said blade member prior to total failure of said blade member.

5. The image forming device of claim 1, wherein said loop includes:

an amplifier coupled to said sensor, said amplifier outputting an amplified signal of said electrical signal;

a circuit coupled to said amplifier, said circuit detecting a build up of frictional and adhesional forces between said blade member and said photosensitive surface by monitoring said amplified signal, said circuit generating an output signal when said amplified signal indicates a build up of frictional and adhesional forces; and a signal generator coupled to said pressure loading means and said circuit, said signal generator sending a signal to said pressure loading means when said signal generator receives said output signal from said circuit, said signal causing said pressure loading means to lessen the pressure loading between said blade member and said photosensitive surface, thereby interrupting the build up of frictional and adhesional forces between said blade member and said photosensitive surface which would otherwise result in damage to said blade member.

6. The image forming device of claim 1, wherein said blade member comprises a cleaning blade having a tip in contact with said photosensitive surface and a blade support member coupled to said means for pressure loading said tip of said cleaning blade against said photosensitive surface.

7. A blade cleaning device for cleaning a surface comprising:

a cleaning blade member having a portion pressure loading the surface to remove substances from the surface;

a sensor on said cleaning blade member, said sensor generating an electrical signal to indicate conditions of said cleaning blade member over a period of use; and a feedback loop to adjust the pressure loading of said blade member against said surface based on said electrical signal, thereby extending the usable lifespan of said blade member.

8. The blade cleaning device of claim 7, wherein one of the conditions indicated by said electrical signal build up of frictional or adhesional forces between said cleaning blade member and said surface.

9. The blade cleaning device of claim 7, wherein said electrical signal varies as said cleaning blade member becomes more worn over the period of use, and certain variations of said electrical signal indicate imminent failure of said cleaning blade member.

10. The blade cleaning device of claim 7 further comprising a monitoring circuit for monitoring said electrical signal to predict imminent failure of said cleaning blade member and generating a signal indicative of imminent failure such that an operator will replace said cleaning blade member prior to total failure of said cleaning blade member.

11. The blade cleaning device of claim 7, wherein said cleaning blade member comprises a cleaning blade and a blade support member, said cleaning blade having a tip portion in contact with the surface.

12. The blade cleaning device of claim 11, wherein said sensor is located between said cleaning blade and said blade support member.

13. The blade cleaning device of claim 11, wherein said sensor is located on said cleaning blade.

14. The blade cleaning device of claim 11, wherein said sensor is located on said blade support member.

15. The blade cleaning device of claim 11, wherein said cleaning blade is made of a polyurethane elastomer.

16. The blade cleaning device of claim 7, wherein said sensor is a piezoelectric sensor.

17. The blade cleaning device of claim 10, wherein said signal activates a display to indicate the imminent failure of said cleaning blade member to the operator.

18. A blade cleaning device for cleaning a surface comprising:

a cleaning blade member having a portion pressure loading the surface to remove substances from the surface; and a piezoelectric sensor on said cleaning blade member, said sensor generating an electrical signal to indicate conditions of said cleaning blade member over a period of use.

19. The image forming apparatus of claim 1, wherein the magnitude of said electrical signal decreases as said blade member becomes more worn over a period of use.

20. The blade cleaning device of claim 7, wherein the magnitude of the electrical signal decreases as said cleaning blade member becomes more worn over a period of use.

21. The image forming apparatus of claim 1, wherein the electrical signal indicates decreased frictional or adhesional forces between said blade member and said photosensitive surface as said blade member becomes worn over a period of use.

22. The blade cleaning device of claim 7, wherein the electrical signal indicates decreased frictional or adhesional forces between said cleaning blade member and said surface as said cleaning blade member becomes more worn over a period of use.

23. The image forming apparatus of claim 2, wherein in response to said build up, said pressure loading means lessens the pressure loading between said blade member and said photosensitive surface.

24. The blade cleaning device of claim 8, wherein in response to said build up, said pressure loading between the portion and the surface is lessened.

25. The image forming apparatus of claim 2, wherein said electrical signal includes a plurality of peaks and spikes, the spikes each representing a said build up and being of greater magnitude than the peaks, wherein each spike indicates potential damage to the blade member.

26. The image forming apparatus of claim 25, wherein the average magnitude of the electrical signal decreases following each spike, the apparatus detecting the decreased magnitudes in order to recognize blade member wear.

27. The image forming apparatus of claim 25, wherein in response to said spikes, said pressure loading means lessens the pressure loading between said blade member and said photosensitive surface.

28. The blade cleaning device of claim 8, wherein said electrical signal includes a plurality of peaks and spikes, the spikes each representing a said build up and being of greater magnitude than the peaks, wherein each spike indicates potential damage to the cleaning blade member.

29. The blade cleaning device of claim 28, wherein the average magnitude of the electrical signal decreases following each spike, the device detecting the decreased magnitudes in order to recognize cleaning blade member wear.

30. The blade cleaning device of claim 28, wherein in response to said spikes, said pressure loading between the portion and the surface is lessened.

31. The blade cleaning device of claim 18, wherein one of the conditions indicated by said electrical signal is the build up of frictional or adhesional forces between said blade member and said photosensitive surface.

32. The blade cleaning device of claim 31, further comprising means for pressure loading said cleaning blade member against said surface, wherein said electrical signal includes a plurality of peaks and spikes, the spikes each representing a said build up and being of greater magnitude than the peaks, wherein each spike indicates potential damage to the cleaning blade member, further wherein in response to said spikes, said pressure loading means lessens the pressure loading between said cleaning blade member and said surface.

* * * * *